United States Patent [19]

Evans et al.

[11] 4,183,056

[45] Jan. 8, 1980

[54] APPARATUS AND METHOD FOR MONITORING SPORTS CONTESTS

[75] Inventors: James D. Evans; Sam L. Pool, both of Houston, Tex.

[73] Assignee: Kewp Electronic Systems, Inc., Houston, Tex.

[21] Appl. No.: 799,539

[22] Filed: May 23, 1977

[51] Int. Cl.[2] ..... H04N 7/18; G03B 23/00

[52] U.S. Cl. ..... 358/108; 340/323 R; 358/93; 358/183

[58] Field of Search ..... 358/93, 108, 183; 340/323; 360/33, 18

[56] References Cited

U.S. PATENT DOCUMENTS

| | | | |
|---|---|---|---|
| 2,943,141 | 6/1960 | Knight | 358/108 |
| 3,810,148 | 5/1974 | Karsten | 340/323 |
| 4,064,540 | 12/1977 | Jetten | 358/183 |

*Primary Examiner*—Howard W. Britton
*Attorney, Agent, or Firm*—Pravel, Gambrell, Hewitt, Kirk, Kimball & Dodge

[57] ABSTRACT

The operation of a television system or photographic camera in concert with line or boundary indicators or monitors at a sporting contest are controlled. When the indicator detects an event of interest during the contest being monitored, such as an intrusion or the presence of an object along a line or boundary, a signal is sent to a video replay recorder, also known as an instant replay system, to continue recording for a predetermined interval and thereafter cease.

An indicator or mark is also transmitted into the recording system on occurrence of the event of interest and is recorded along with the continuing event until recording ceases. After recording ceases, operators of the television system may then play back the recorded event into the television system. During the play back, the recorded indicator is also transmitted into the television system to appear on television screens and indicate the time of occurrence of the event of interest.

A photographic camera may also be caused to photograph the event in response to the indicator in conjunction with the replay recorder, or separate therefrom.

24 Claims, 9 Drawing Figures

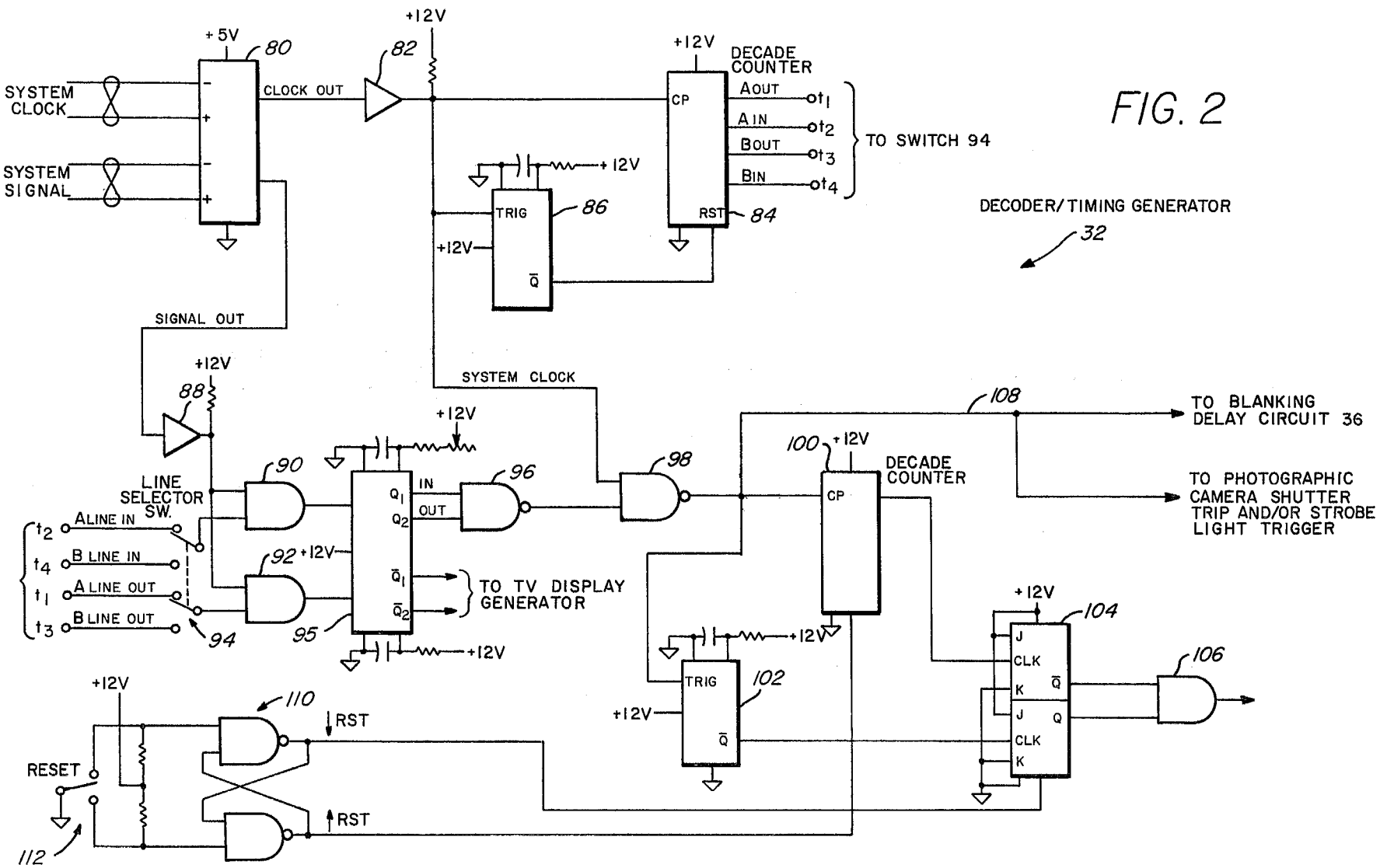
FIG. 2
DECODER/TIMING GENERATOR
32
TO BLANKING DELAY CIRCUIT 36
TO PHOTOGRAPHIC CAMERA SHUTTER TRIP AND/OR STROBE LIGHT TRIGGER
TO SWITCH 94
DECADE COUNTER
AOUT
AIN
BOUT
BIN
CP
RST
+12V
84
86
TRIG
Q̄
82
CLOCK OUT
80
+5V
SYSTEM CLOCK
SYSTEM SIGNAL
SIGNAL OUT
88
SYSTEM CLOCK
98
96
IN
OUT
Q1
Q2
TO TV DISPLAY GENERATOR
95
90
92
94
LINE SELECTOR SW.
ALINE IN
B LINE IN
ALINE OUT
B LINE OUT
t1
t2
t3
t4
108
100
DECADE COUNTER
102
104
106
J
CLK
K
Q
110
RST
RESET
112

APPARATUS AND METHOD FOR MONITORING SPORTS CONTESTS

BACKGROUND OF THE INVENTION

1. Field of Invention

The present invention relates to electronic systems for monitoring sports contests.

2. Description of the Prior Art

Several types of indicators exist for assisting officials monitoring events of interest, particularly those along lines or boundaries, at sports contests. Examples are those for determining whether a tennis ball lands in or out of play during tennis matches. One type of indicator is an electronic-laser indicator, as set forth in U.S. Pat. No. 3,810,148, of which Applicants are two of the inventors. Other types of line indicators include those utilizing pressure sensitive tape as the line or boundary and those based on the principle of detection of magnetic particles in the ball.

In the event that an official's call is disputed, the indicator signal may be consulted. It would be desirable to verify the determination of both the official's call and the indicator signal in the event the two differ, or a continued dispute in the event the two are the same. Television instant replay systems have been extensively used in sports events, and would appear suitable for this purpose.

Determination of the time of impact of the ball near a boundary, however, creates a problem for both photographers and television replay equipment operators. Unless the replay equipment is activated at the proper time to retain the impact of the ball on or near the boundary, the event of interest may be missed or improperly recorded. Further, other problems exist. For example, in some sports the ball often moves so swiftly that even during slow motion or stop action instant replay the ball appears as an elongate or stretched blur rather than as a distinct, discrete object.

SUMMARY OF INVENTION

Briefly, the present invention provides a new and improved apparatus and method for controlling the operation of a television system, which includes a replay recorder, at sports contests to monitor events of interest during the contest. The apparatus controls the replay recorder to store video information for intervals prior to, during and after the event of interest, as detected by an electronic line or boundary indicator or other suitable line or boundary indicator.

The apparatus further forms an indicator mark which is provided to the replay recorder. The mark indicates, as a video image to be recorded by the replay recorder, the time of occurrence of event being monitored. Once recorded, the mark is then displayed on play back along with the event of interest. If desired, a character generator may be used to form a message stating the indication detected and the nature of the event detected or decision made by the line indicator.

With the present invention, the replay recorder system is controlled so that an indication is visible in the television system of the time of occurrence of the event being monitored by the indicator. Accordingly, even if the ball used during the event is moving so rapidly as to form a blurred image on the television system, the indicator mark clearly identifies the time of occurrence of the event being monitored by the indicator.

The apparatus and method of the present invention may also be used to control the operation of a photographic camera in conjunction with a line indicator at sports contests, either in conjunction with or separately from the television system, as well.

It is an object of the present invention to provide a new and improved method and apparatus for monitoring sports contests.

BRIEF DESCRIPTION OF THE DRAWINGS

FIGS. 2 through 8 are each schematic electrical circuit logic diagrams of portions of the apparatus of FIG. 1.

DESCRIPTION OF THE PREFERRED EMBODIMENT

Table of Contents

I. System Outline
II. Detailed Description of Component Circuits
A. Decoder/Timing Generator 32
B. Blanking Delay Circuit 36
C. Counter Control Circuit 40
D. Horizontal Counter/Comparator 48
E. Vertical Counter/Comparator 52
F. Indicator Generator 56
G. Interface Select Circuit 68
III. Photographic Camera Control
IV. Operation of Invention

I. SYSTEM OUTLINE

Figure 1:
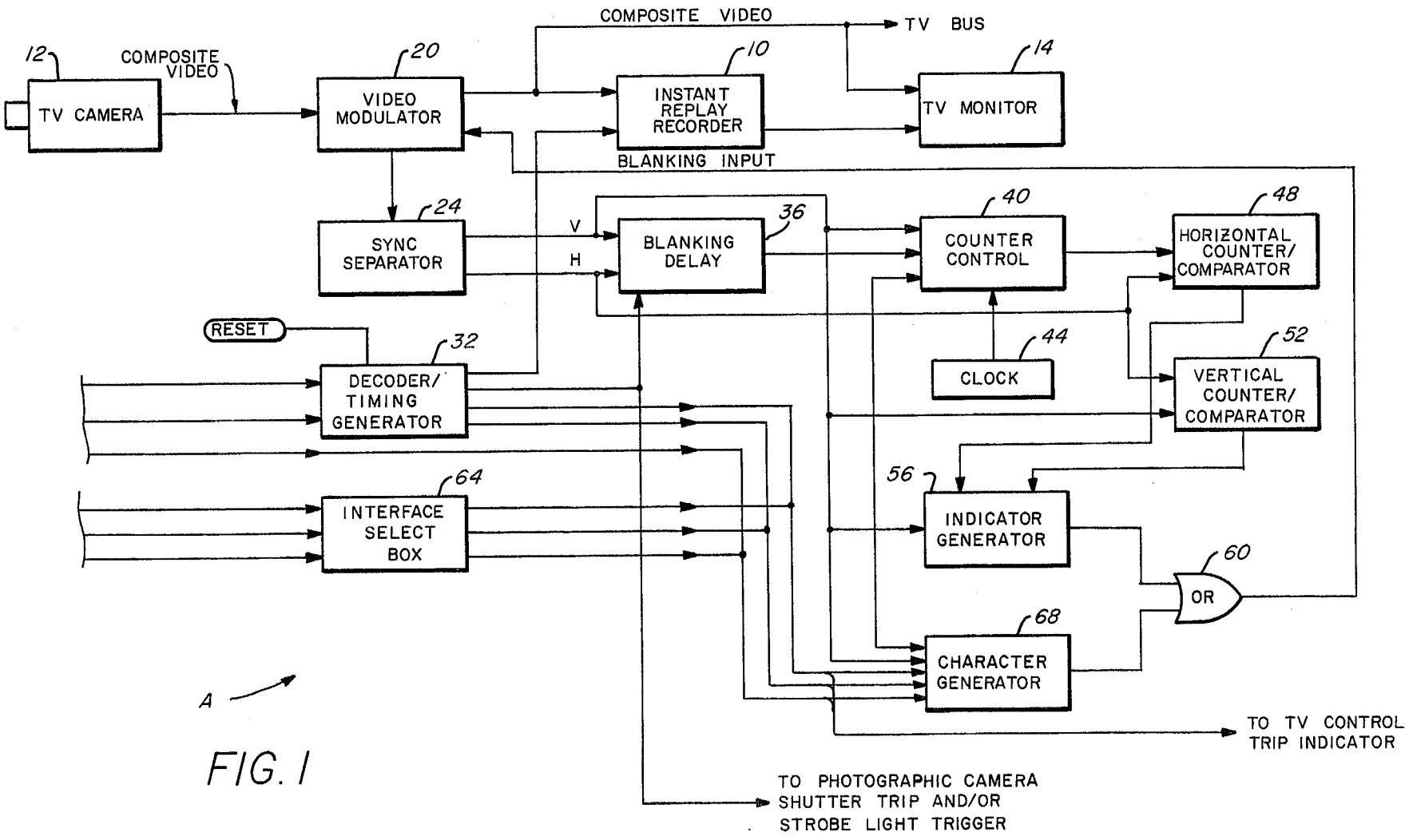
FIG. 1 is a schematic diagram of an apparatus according to the present invention.
Figure 3:
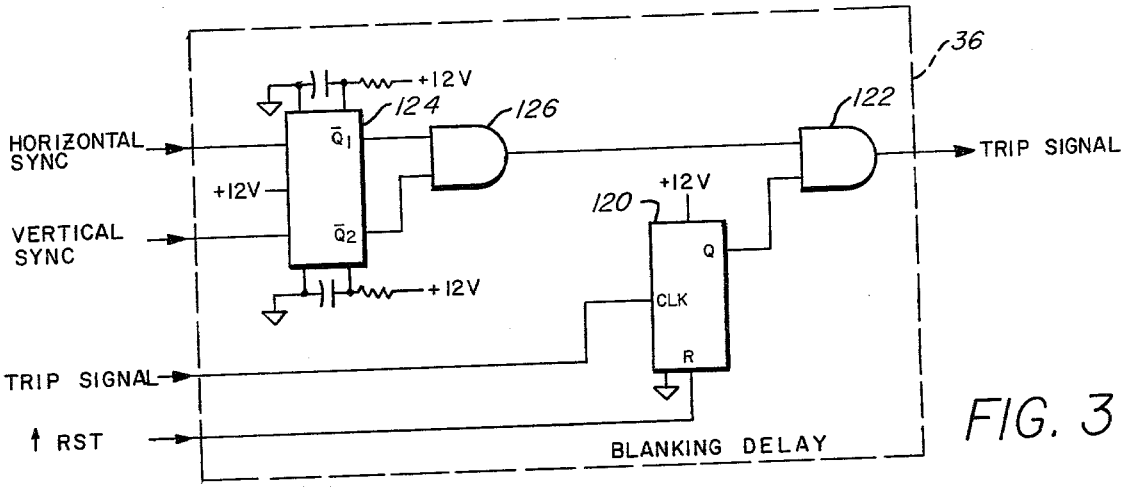
Figure 4:
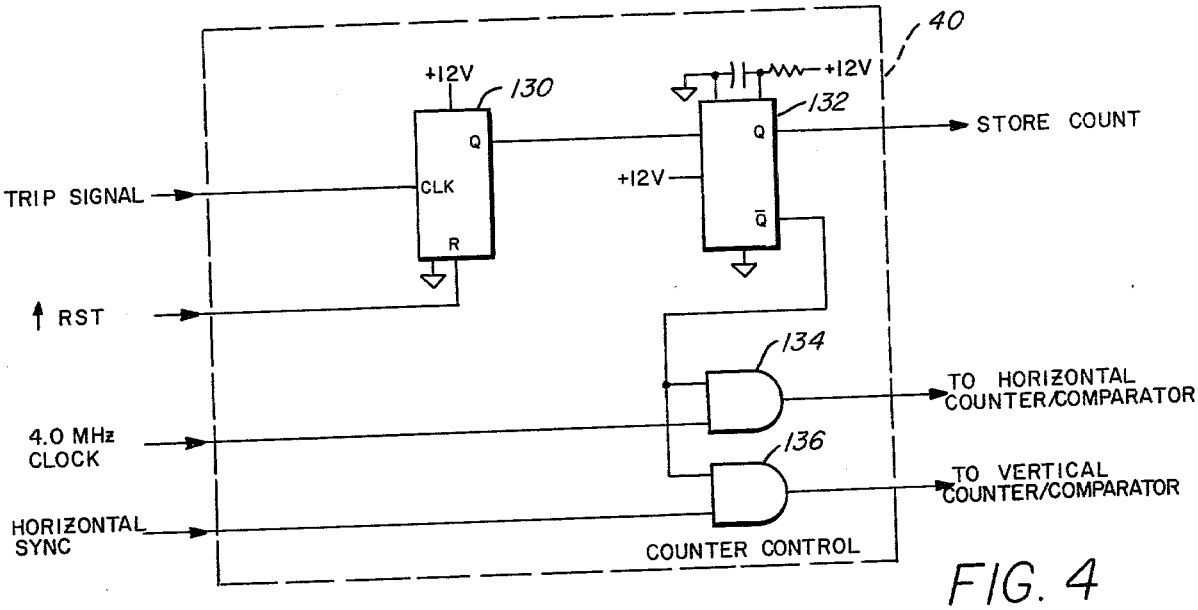

In the drawings, an apparatus A for monitoring events of interest during a sports contest or event is illustrated in schematic block diagram form in FIG. 1. As will be set forth in detail below, the apparatus A controls the operation of a photographic camera and/or a television system, which includes a conventional replay recorder 10, commonly known as an instant replay unit. As is conventional, the replay recorder 10 is electrically connected to receive the video signals from a conventional television camera 12, which may be of either the color or black-and-white type. The camera 12 is also directly connected to a monitor television screen 14, as is conventional, to permit the operating crew of the television system to observe the sporting event as seen by the camera 12. As is conventional, the replay recorder 10 when activated ceases recording after a predetermined interval and stores a video image of events occurring for a fixed time interval prior to cessation of recording. The replay recorder 10 may then be activated by the operating crew of the television system to furnish the recorded video image to the monitor 14 for display to the television crew, and for re-display to persons watching the sports event on television at local or remote television sets.

The apparatus A includes a line indicator L, such as that of the type set forth in U.S. Pat. No. 3,810,148, which is incorporated herein by reference. Alternatively, the apparatus A may be utilized in conjunction with other types of line indicators such as those utilizing pressure sensitive tape as the line or boundary at the sports event or those based on the principle of detection of magnetic particles in the ball being used during the sports event. The apparatus A correlates the recording by the recorder 10, of the sports event being monitored with the operation of the line indicator L to permit an indication to be visible on the television system of the time of occurrence of the event being monitored by the indicator L.

When the apparatus A is used to control the operation of a photographic camera such as to verify a questionable decision, the camera is energized by the trip signal from the decoder/timing generator 32 and forms a photographic image of the event detected by the indicator L. As has been set forth, the photographic camera may be used together with or separate from the television system.

Although in the preferred embodiment hereinbelow the apparatus A is described as being utilized with the indicator L in conjunction with a tennis event, it should be understood that the apparatus A may also be utilized in conjunction with television systems during television of other types of sports contests and events.

Considering now the remainder of the apparatus A with respect to the television system, a conventional video modulator 20 is electrically connected between the television camera 12 and replay recorder 10. The modulator 20 serves to interconnect the apparatus A with the television system. Further, when energized by an input signal, formed in a manner to be set forth, the modulator 20 clamps the incoming video signal to an appropriate level, such as ground when the white level is a positive voltage, blanking the video image output from the camera 12 for the duration of the input signal. A conventional synchronization signal separator circuit 24 is electrically connected to the video modulator circuit 20 to extract horizontal and vertical synchronization pulses from the video signal from camera 12 in order to insure synchronized operation of the apparatus A with the television system.

The apparatus A further includes a decoder/timing generator circuit 32 which receives input signals from the indicator L in the form of a trip signal, termed a SYSTEM SIGNAL, indicating an event of interest has been detected by the indicator L, and a clock signal, termed SYSTEM CLOCK, so that the display of the event detected by the indicator L can be synchronized for display on the television system by the apparatus A. The decoder/timing generator circuit 32 further forms a trip signal for transfer to the replay recorder 10 in response to the SYSTEM SIGNAL indicating occurrence of the event of interest detected by the indicator L. As will be set forth, the recorder 10 continues to record for a predetermined interval in response to the receipt of the trip signal from the decoder circuit 32, for example one-half of its record interval, and then ceases recording operations, thereby storing the event detected by the indicator L and observed by the camera 12. The operating crew of the television system may thereafter replay recorded events on monitor 14 from the recorder 12, and if desired transmit the recorded video image over a conventional video bus for viewing on sets of television viewers of the sports event.

As is known, during periodic, repeated portions of the operating cycle of a television system, horizontal and vertical synchronization pulses are present during intervals known as horizontal blanking intervals and vertical blanking intervals, respectively, when no video image is present. A blanking detector circuit 36 of the apparatus A receives the trip signal from the detector circuit 32 and further receives horizontal and vertical synchronization pulses from the synchronization separator circuit 24. In the event of a trip signal from the detector circuit 32 during a blanking interval, the blanking delay circuit 36 delays the signal until both horizontal and vertical blanking intervals have expired in order that occurrence of the event of interest may be visibly indicated on the television screen.

The blanking delay circuit 36 in the absence of blanking signals permit the trip signal to pass to a counter control circuit 40. The counter control circuit 40 receives the horizontal and vertical synchronization pulses from the synchronization separator circuit 24 in order to operate in synchronism therewith. The counter control circuit 40 further receives pulses from a fixed frequency oscillator or clock 44 at a frequency, such as 4 MHZ, substantially greater than the horizontal scan rate of the television system to divide each of the horizontal scans into a discrete number of count intervals.

A horizontal counter/comparator circuit 48 receives clock pulses from the counter control circuit 40 in registers therein to maintain a record of the present location along the horizontal scan of the television raster. Similarly, a vertical counter/comparator circuit 52 receives horizontal synchronization pulses from the synchronization separator 24 and stores a count thereof in registers in order to maintain a record of the present vertical line of the television raster scan, for reasons to be set forth.

On receipt of a trip signal from the blanking delay circuit 36, the counter control circuit 40 activates storage registers in the circuits 48 and 52 causing the present counts of such circuits to be stored, indicating the location of the raster scan at the occurrence of the event of interest being monitored. An indicator generator circuit 56 is activated at this time and thereupon generates an indicator mark which is provided to the replay recorder 10 indicating the time of occurrence of the event of interest. The output of the generator circuit 56 is provided through an OR gate 60 to the video modulator 20.

Comparators are included in the circuits 48 and 52 to detect during each subsequent counting cycle of the counter portions thereof the time at which the count stored in the storage registers equals the present count of the counters so that the indicator generator may again be energized. In this manner, the indicator generator 56 is energized for repeated horizontal scans and for repeated vertical scans in order to display and indicate a mark of sufficient size to be visible on the screen of the television monitor 14.

An interface circuit 64 is connected to the indicator L and detects the nature of the decision made by the indicator L, providing a signal indicating the nature of the decision detected by the indicator L to a suitable indicator in the control room, alerting the operator of the television system that an event of interest has occurred, as well as indicating the nature of the decision made by the indicator L.

The interface circuit 64 is further connected to a conventional matrix character generator circuit 68 which forms messages for provision to the replay recorder 10 to indicate the nature of the event of interest, as detected and indicated by the interface circuit 64. The character generator circuit 68 provides characters, when generated therein, through the OR gate 60 to the video modulator 20.

II. DETAILED DESCRIPTION OF COMPONENT CIRCUITS

The video modulator 20, the synchronization separator circuit 24, the oscillator or clock 44, the OR gate 60 and the character generator 68 are conventional, commercially available items. Accordingly, since these circuits are conventional, a detailed description of the components and structure thereof is not presented in order to preserve brevity in the disclosure of the present invention.

A. DECODER/TIMING GENERATOR 32

Considering now the decoder/timing generator circuit 32 (FIG. 2), such circuit receives the two input signals, SYSTEM CLOCK and SYSTEM SIGNAL from the electronic line indicator apparatus L on separate twisted pair, balanced to ground transmission lines. The SYSTEM CLOCK signal includes a periodically repeated absence of pulse as a synchronization signal termed a "sync space". A dual differential line receiver 80 receives both signals and forms output signals which are reproductions of the signals received. The SYSTEM CLOCK output is fed to a level converter 82 and therefrom to the decoder portion of the circuit 32 and also to a digital counter 84 that provides a sequence of at least four timing pulses, t1 through t4. Interval t1 is for a first line, termed a LINE "OUT", t2 is A LINE "IN", and t3 and t4 are for a second line, termed B LINE "OUT" and "IN" intervals, which are provided for the decoder portion of the circuit 32.

A missing pulse detector circuit 86, a monostable multivibrator, receives the system clock from level converter 82 at a trigger input. The time constant of the monostable multivibrator 86 is set to 1.5 times the SYSTEM CLOCK period. So long as the monostable multivibrator 86 receives a trigger pulse from level converter 82 before the time limit set by the time constant is reached, the missing pulse detector 86 is retriggered and the time constant begins over, and $\overline{Q}$ output of detector 86 remains low. When the sync space in the SYSTEM CLOCK signal arrives, the time limit of the monostable multivibrator 86 elapses and the $\overline{Q}$ output thereof goes to logic "1", resetting the counter 84. When the next SYSTEM CLOCK pulse arrives, the monostable multivibrator 86 resets and permits the counter 84 to be released on the next SYSTEM CLOCK pulse. In this manner, the counter 84 counts a fixed number of pulses and then is reset by the sync space in the incoming signal and starts the count over. The timing generator portion of circuit 32 thus synchronizes this circuit 32 to the SYSTEM CLOCK of the line indicator L.

The SYSTEM SIGNAL which is received by the line receiver circuit 80 from the indicator L contains a line pair of two pulses per line monitored, one "IN" and one "OUT" pulse, for a total of 14 pulses for an entire count for playing tennis. When the indicator L detects that a line pair is interrupted, one or both of the pulses associated with that line disappear. The trip decoder portion of circuit 32 recognizes the absence of one or both such pulses and generates a display trigger, and if the interruption was caused by a ball, a ball trip signal. The ball trip signal is used by the television crew to switch in the instant replay recorder 10 or reset the display system as required. If the ball trip signal does not occur after a line interruption and a Foot Fault is not being monitored, the display system is reset by the operator or can be configured to reset automatically.

The SYSTEM SIGNAL from line receiver circuit 80 is applied to a level converter amplifier 88 and the output is provided to AND gates 90 and 92. The AND gate 90 is also connected through a detector switch 94 to receive either timing pulse t2 (LINE A "IN") or timing pulse t4 (LINE B "IN") depending on the position of switch 94. Similarly, AND gate 92 is connected through switch 94 to receive either timing pulse t1 (LINE A "OUT") or timing pulse t3 (LINE B "OUT"). Thus, depending on the position of switch 94, AND gates 90 and 92 receive "IN" and "OUT" scanning pulses, respectively, from counter 84 along with the SYSTEM SIGNAL, and provide output "IN" and "OUT" signal pulses to a dual missing pulse detector 95.

The dual missing pulse detector 95 includes two monostable multivibrators therein which maintain their output terminals, $Q_1$ and $Q_2$, respectively, at a logic "1" level until a missing pulse is detected. In the event one or both pulses are missing, one or both of the outputs $Q_1$ and $Q_2$ of detector 96 go to logic "0" depending on the number of missing pulses. If either of these two outputs of detector 95 go to logic "0", the output of a NAND gate 98 is driven to logic "1". The output of NAND gate 96 is provided to a NAND gate 98, which also receives SYSTEM CLOCK pulses from pulse detector 86. When the output of gate 96 goes to logic "1", gate 98 applies SYSTEM CLOCK pulses to a decade counter 100.

The SYSTEM CLOCK pulses from gate 98 are furnished to a retriggerable monostable 102 with a time constant of more than twice the period of SYSTEM CLOCK signals. A $\overline{Q}$ output of monostable 102 goes to logic "0" when the clock pulses are applied to an input thereof. The $\overline{Q}$ output will remain at logic "0" as long as the clock pulses are present, which corresponds to the length of the interval during which the line is detected as being interrupted. When the interruption is removed, the clock pulses from gate 98 stop. Two clock periods later, the $\overline{Q}$ output of monostable 102 returns to logic "1" thereby setting a dual JK flipflop 104.

If the line interruption period is less than 10 SYSTEM CLOCK pulses long, then a BALL TRIP signal will be generated by an AND gate 106, since both the $\overline{Q}_1$ and $\overline{Q}_2$ outputs of flip-flop 104 are at logic "1". If the line is interrupted for more than ten clock pulses then $\overline{Q}_1$ output of flip-flop 104 is set by counter 100 inhibiting the AND gate 106. In this manner, the trip decoder portion of the circuit 32 distinguishes between an interruption caused by a swiftly moving ball and an interruption caused by a more slowly moving object.

The output of the gate 98 serves as a trip signal and is provided to the blanking delay circuit 36 and also over a conductor 108 as a television display trip signal. The trip signal formed on conductor 108 in decoder circuit 32 is also suitable to trigger a photographic camera, if desired, in a manner to be set forth. The signal occurs 1.5 time intervals after the line was interrupted. The BALL TRIP signal is generated by the gate 106 when the line is restored, providing that ten SYSTEM CLOCK periods have not elapsed. This switching method is used to insure that the video recorder 10 is switched from record to play back at the earliest moment.

As a result of this rapid switching, some false switches may arise, but the provision of images from replay recorder 10 to the video bus is controlled by an operator the false event is not connected into the system. The operator has two lights that tell the operator that a trip has occurred and whether the trip is true or false.

The apparatus A is reset by a standard switch debounce latch circuit 110 in response to a RESET button 112. The outputs of the gates in latch circuit 110 are designated RST with an upwardly pointing or downwardly pointing arrow, as is evident, and are furnished to inputs of various other circuits of the apparatus A. To preserve clarity in the drawings, these connections are not shown. Rather, the particular output signal from circuit 110 provided as an input to the various other modules of apparatus A is designated at each input in a like manner to the particular output. In this manner, the apparatus A may be reset independently of the indicator L in the event of a false trip indication.

B. BLANKING DELAY CIRCUIT 36 (FIG. 3)

The blanking delay circuit 36 serves to delay any trip signal from decoder circuit 32 that may occur in the horizontal or vertical blanking interval of the television system until the television system is out of the blanking interval. Without such a blanking delay, a trip signal occurring in the blanking interval generates an off screen display and would not be recorded on the replay recorder 10.

The low to high transition of the first trip signal from decoder circuit 32 sets a JK flip-flop 120 by applying a pulse to the CLK input thereof. The flip-flop 120 is reset by the system reset switch 112, as indicated. The Q output of flip-flop 120 is logic "1" in the set condition and is applied to an input of an AND gate 122. The other input of AND gate 122 is logic "1" except during the television blanking intervals. A dual monostable multivibrator 124 has $\overline{Q}_1$ and $\overline{Q}_2$ outputs which are logic "1" except during the blanking intervals when synchronization pulses are present in the television system. The $\overline{Q}_1$ output goes to logic "0" during the horizontal synchronization pulse or blanking interval and the $\overline{Q}_2$ output goes to logic "0" during the vertical synchronization pulse or blanking interval. At all other times these outputs are at logic "1". The dual monostable multivibrator 124 thus lengthens the blanking intervals sufficiently to insure that the wedge image is displayed on the monitor screen.

The $\overline{Q}_1$ and $\overline{Q}_2$ outputs of multivibrator 124 are furnished to an AND gate 126, whose output is furnished as an input to the gate 122. When both outputs of multivibrators 122 are logic "1", the output of gate 126 is also at logic "1". If one or both of the outputs of multivibrator 124 are logic "0", the output of gate 126 is a similar logic level. Thus, the trip signal is gated to the counter control circuit 40 through the gate 122 only when both outputs of multivibrator 124 are logic "1", signifying absence of blanking intervals. When gate 126 is at logic "0", during either one of the blanking periods, the trip signal is inhibited from passing through the gate 122 until the blanking interval has expired.

C. COUNTER CONTROL CIRCUIT 40 (FIG. 4)

The counter control circuit 40 receives the trip signal from the blanking delay circuit 36 at a CLK input of a JK flip-flop 130, which thus sets the flip-flop 130. The Q output of flip-flop 130 goes to logic "1" at this time triggering a monostable multivibrator 132 causing a Q output thereof to go to a logic "1" and a $\overline{Q}$ output to go to a logic "0" for a suitable time interval, such as approximately 700 nanoseconds. The $\overline{Q}$ output of monostable 132 is connected to inputs of AND gates 134 and 136. AND gate 134 receives clock pulses from the clock 44, while AND gate 136 receives television horizontal synchronization pulses from the synchronization separator circuit 24. When the $\overline{Q}$ output of monostable 132 is logic "0" the gates block the horizontal sync pulses and clock pulses from passing to the counters. The Q output of monostable 132 is connected to the horizontal counter/comparator circuit 48 and the vertical counter/comparator circuit 52 for reasons to be set forth. After the time constant of the monostable 132 expires, the gates 134 and 136 are again enabled permitting the clock and horizontal sync pulses to pass to the counter/comparator circuits 48 and 52.

D. HORIZONTAL COUNTER/COMPARATOR 48 (FIG. 5)

The television horizontal sync pulse from sync separator 24 is provided as an input to horizontal counter/comparator 48 at a RESET input of a binary counter module 140. The counter 140 after reset counts 4 MHZ clock pulses from clock 44 until the next horizontal sync pulse at the RESET input or until a trip signal is received. The counter 140 has at least eight output terminals, $Q_0$ through $Q_7$, forming an 8 bit binary output count. $Q_0$ is the least significant bit and $Q_7$ is the most significant bit. The output terminals of counter 140 are connected to the D inputs of an 8 bit latch circuit, comprised of latch modules 142 and 144, and to the A input pins of an 8 bit comparator, comprised of comparator modules 146 and 148. The Q output pins of the 8 bit latch are connected to the B inputs of the 8 bit comparator.

The horizontal counter/comparator 48 operates in repeated reset and count cycles until a trip signal is received from counter control circuit 40. At this time, the counters 140 momentarily stops and the count therein is transferred into the 8 bit latch by the trip signal at the CLK terminal of modules 142 and 144. The counter 140 is then released and resumes counting. During each further counting cycle, when the count of counter 140 equals the count stored in the modules 142 and 144 of the 8 bit latch, the comparators 146 and 148 generate a HORIZONTAL COMPARE output pulse which is provided to an AND gate 150. A HORIZONTAL COMPARE output pulse is also generated each time the 8 bit latch and the counter 140 are simultaneously reset. This is a false output and is inhibited by providing the output from flip-flop 130 in counter control circuit 40 at the other input to the AND gate 150. In this manner, unless a trip signal is present, AND gate 150 inhibits false HORIZONTAL COMPARE outputs so that an output from gate 150 is present only when a trip signal has occurred. This HORIZONTAL COMPARE output continues for each horizontal scan after a trip signal until the apparatus A is reset by switch 112.

E. VERTICAL COUNTER/COMPARATOR 52 (FIG. 6)

The television vertical sync pulse from sync separator 24 is provided as an input to vertical counter/comparator 52 at a RESET input of a binary counter module 160. The counter 160 after reset counts horizontal sync pulses until the next vertical pulse at the RESET input or until a trip signal is received. The counter 160 has at least eight output terminals $Q_0$ through $Q_7$, forming an 8 bit binary output count, $Q_0$ being the least significant bit and $Q_7$ the most significant bit. The output terminals of counter 160 are connected to the D inputs of an 8 bit latch circuit, comprised of latch modules 162 and 164, and to the A input pins of an 8 bit comparator, comprised of comparator modules 166 and 168. The output pins of the 8 bit latch are connected to the B inputs of the 8 bit comparator.

The vertical counter/comparator 52 operates in repeated reset and count cycles until a trip signal is received from counter control circuit 40. At this time the counter 160 momentarily stops and the count therein is transferred into the 8 bit latch by the trip signal at the CLK terminal of modules 162 and 164. The counter 160 is then released and resumes counting. During each further counting cycle when the count of counter 160 equals the count stored in modules 162 and 164 of the 8 bit latch, the comparators 166 and 168 generate a VERTICAL COMPARE output pulse which is provided to an AND gate 170. A VERTICAL COMPARE output pulse is also generated each time the 8 bit latch and the counter 160 are simultaneously reset. In a like manner to gate 150 in the horizontal counter/comparator 48, the gate 170 receives a trip signal from counter control circuit 40 to inhibit and prevent a false VERTICAL COMPARE signal when the 8 bit latch and the counter 160 are simultaneously reset.

F. INDICATOR GENERATOR 56 (FIG. 7)

The HORIZONTAL COMPARE pulse from the horizontal counter/comparator 48 is received as an input signal by an AND gate 174 in indicator generator 56. The VERTICAL COMPARE pulse from the vertical counter/comparator 52 is received at a CLOCK input of a JK flip-flop 176, driving a Q output thereof to a logic "1" level. The Q output of flip flop 176 is furnished as a second input to the AND gate 174. The output of gate 174 is provided to a monostable multivibrator 178. When both inputs of AND gate 174 are logic "1" the monostable 178 is triggered to provide an output pulse at a $\overline{Q}$ output. This cycle continues until the next vertical sync pulse from sync separator 24 resets the flip-flop 176. The AND gate 174 is then disabled and the monostable 178 is thus no longer triggered by the HORIZONTAL COMPARE pulses.

The output pulse width of monostable 178 is controlled by the horizontal sync pulse integrator 180, to be discussed below. The output pulses from $\overline{Q}$ output of the monostable 178 are fed through the OR gate 60 along with the output of the character generator 68 and are applied to the blanking circuit in the video modulator 20, as has been set forth.

In the horizontal sync pulse integrator 180, a transistor 182 which is driven into saturation when the $\overline{Q}$ output of flip-flop 176 goes to logic "1" on reset by the vertical sync pulse. Transistor 182 in saturation clamps capacitor 184 to ground, discharging the capacitor 184 and inhibiting the horizontal sync integrator. When the VERTICAL COMPARE pulse sets flip-flop 176, the capacitor 184 of integrator circuit 180 is released and begins integrating the horizontal sync pulses received from sync separator 24. Transistors 186 and 188 amplify the voltage from the charge stored in the integrating capacitor 184. Transistor 188 controls the conductance of a transistor 190, which effectively varies the series resistance to a charging capacitor 192 on the monostable 178.

The width of the output pulses from monostable 178 is determined by the capacitance of capacitor 192 and the series resistance of a network consisting of transistor 190, resistors 194 and 196, and a variable resistance 198. The pulse width may be adjusted by changing the resistance of variable resistor 198.

When the voltage on capacitor 184 is discharged to ground level, transistor 186 is cutoff, holding transistor 188 in cutoff so that transistor 190 is on, saturated. Transistor 190 when saturated shunts resistors 194, 196 and 198 with a low impedance. The time constant of the monostable 178 with transistor 190 saturated is thus based almost entirely on capacitor 192 and transistor 190 and is thus at a minimum value yielding the shortest output pulse width. As the voltage on capacitor 184 rises, the transistor 190 is driven to cut off. When transistor 190 is off, the time constant of the monostable 178 includes the effect of resistors 194, 196 and 198 and thus the pulse width of monostable 178 is at its maximum.

The width of the output pulse from integrator circuit 180 determines the time interval that video modulator 20 is clamped to ground, blanking out a portion of the video image in the television system. The width of the pulse increases for each successive horizontal line of the raster scan of the television system so that a wedge-shaped dark spot is formed during the television frame in which the event is detected by the indicator L and furnished to the apparatus A for recording by the recorder 10. The exact time of occurrence of the interruption detected by the indicator L is identified in the recorded video image by the time of occurrence of the initial tip of the wedge.

G. INTERFACE SELECT CIRCUIT 68 (FIG. 8)

The interface select circuit 68 controls the character generator 68 to display an appropriate character to be displayed, such as the word "IN" or "OUT", and triggers the character generator 68. JK flip-flops 200 and 202 are reset by the system reset switch 112. The $\overline{Q}$ output of flip-flop 202 is logic "1" in the reset state and holds the J input of flip-flop 200 at logic "1". Similarly, the $\overline{Q}$ output of flip-flop 200 is logic "1" and holds the J input of flip-flop 202 at a like level. With both J inputs held at logic "1" either flip-flop can be triggered by an appropriate output pulse from flip-flop 94 (FIG. 2) of decoder circuit 32.

Once one of flip-flops 200 or 202 is set or triggered, the set flip-flop of the two will hold the other flip-flop in the reset state to prevent triggering of both words from character generator 68 on the display. When an IN trip is received from decoder 32 flip-flop 200 sets enabling the IN character of the character generator 68, and the Q output of flip-flop 200 also enables the character generator 68. Simultaneously, the $\overline{Q}$ output of flip-flop 200 goes to logic "0" inhibiting flip-flop 202 and holding same in the reset state. The Q outputs of flip-flops 200 and 202 provided to an OR gate 204 so that either an IN or OUT trip will enable the character generator 68. Once the character generator 68 is enabled, it continues to operate until the system reset pulse is provided to reset both flip-flop 200 and 202.

III. PHOTOGRAPHIC CAMERA CONTROL

The apparatus A can also be used to control the photographic camera either in conjunction with or separately from the television system. The output from the decoder portion of circuit 32 on conductor 108 is provided as a trip signal to the camera. The photographic camera is of the type responding to an electrical input signal to form a photographic image.

The camera is also of a suitable shutter speed to record photographically the events of interest occurring during the sports contest being monitored. Further, where necessary, the signal on conductor 108 may also be used to energize a strobe light operating in conjunction with the camera. The photographic image recorded with the camera controlled by the apparatus A is available should an official decision be disputed, as well as when a dispute exists as to the accuracy of the events played back by the replay recorder 14. It should be understood that the apparatus A may be connected to activate either the television system or the camera, or both concurrently, in response to the indicator L, as desired. Further, when the apparatus A is used in conjunction with a photographic camera alone, only the decoder/timing generator circuit 32 portion of the apparatus A need be energized.

IV. OPERATION OF INVENTION

In the operation of the apparatus A, a suitable number of indicators L for monitoring lines or boundaries of interest during the sports contest or event are established. As has been set forth, the apparatus A is capable of controlling the operation of two or more indicators L. The apparatus A is further interconnected into the television system, preferably with one apparatus for each replay recorder 10.

The indicators L monitor events of interest along the line or boundary to which they are assigned. If one of the indicators L forms a trip signal, indicating an event of interest has been detected, such signal is then transferred to the replay recorder 10 and/or the photographic camera.

The camera photographs the event detected. The recorder 10 continues to record for one-half of its record interval in response to the receipt of the trip signal from the decoder circuit 32, and then ceases recording operations, thereby storing the event detected by the indicator L and observed by the camera 12. The operating crew of the television system may thereafter replay recorded events on monitor 14 from the recorder 12, and if desired transmit the recorded video image for viewing on sets of television viewers of the sports event.

The blanking delay circuit 36 in the absence of blanking delays permit the trip signal to pass to the counter control circuit 40. In the event of a trip signal from the detector circuit 32 during a blanking interval, the blanking delay circuit 36 delays the trip signal until blanking delays have expired before providing the trip signal to counter control circuit 40. The counter control circuit 40 also receives the horizontal and vertical synchronization pulses from the synchronization separator circuit 34 and pulses from the clock 44 to divide each of the television fields into a discrete number of horizontal and vertical count intervals.

On receipt of a trip signal from the blanking delay circuit 36, the counter control circuit 40 activates storage registers in the circuits 48 and 52 causing the present counts of such circuits to be stored, indicating the location of the raster scan beam at the time of occurrence of the event of interest being monitored. The indicator generator circuit 56 is also activated at this time and thereupon generates the indicator mark or wedge which is provided to the replay recorder 10 indicating the time of occurrence of the event of interest.

Figure 9:
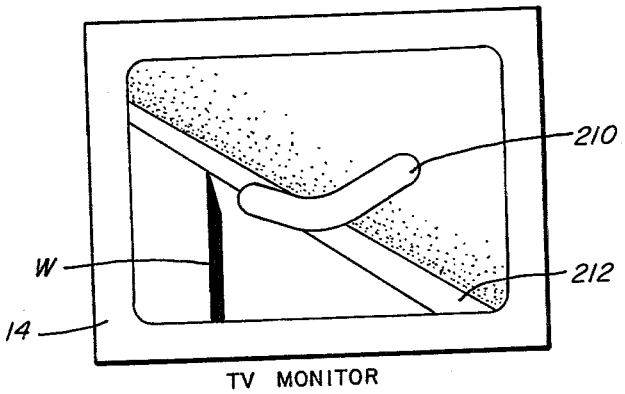
FIG. 9 is a schematic representation of a television image formed according to the present invention.
Figure 5:
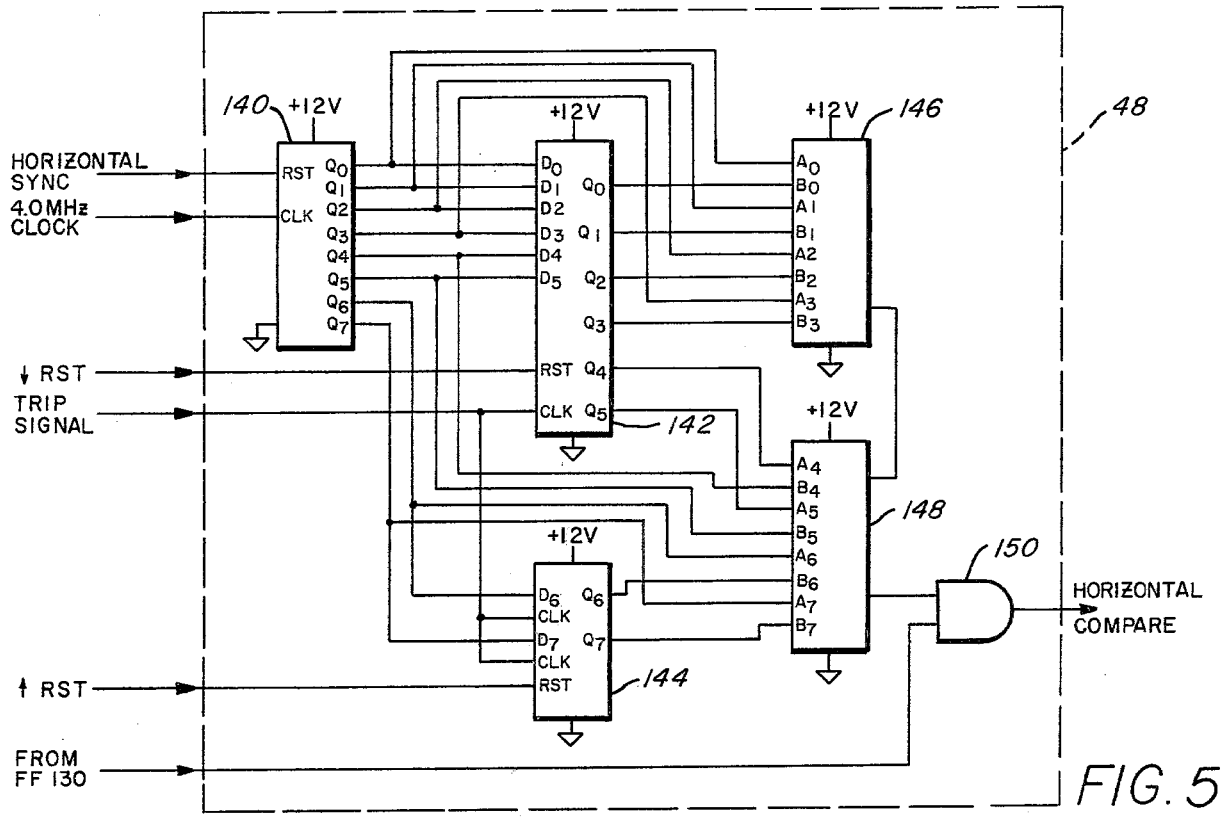
Figure 6:
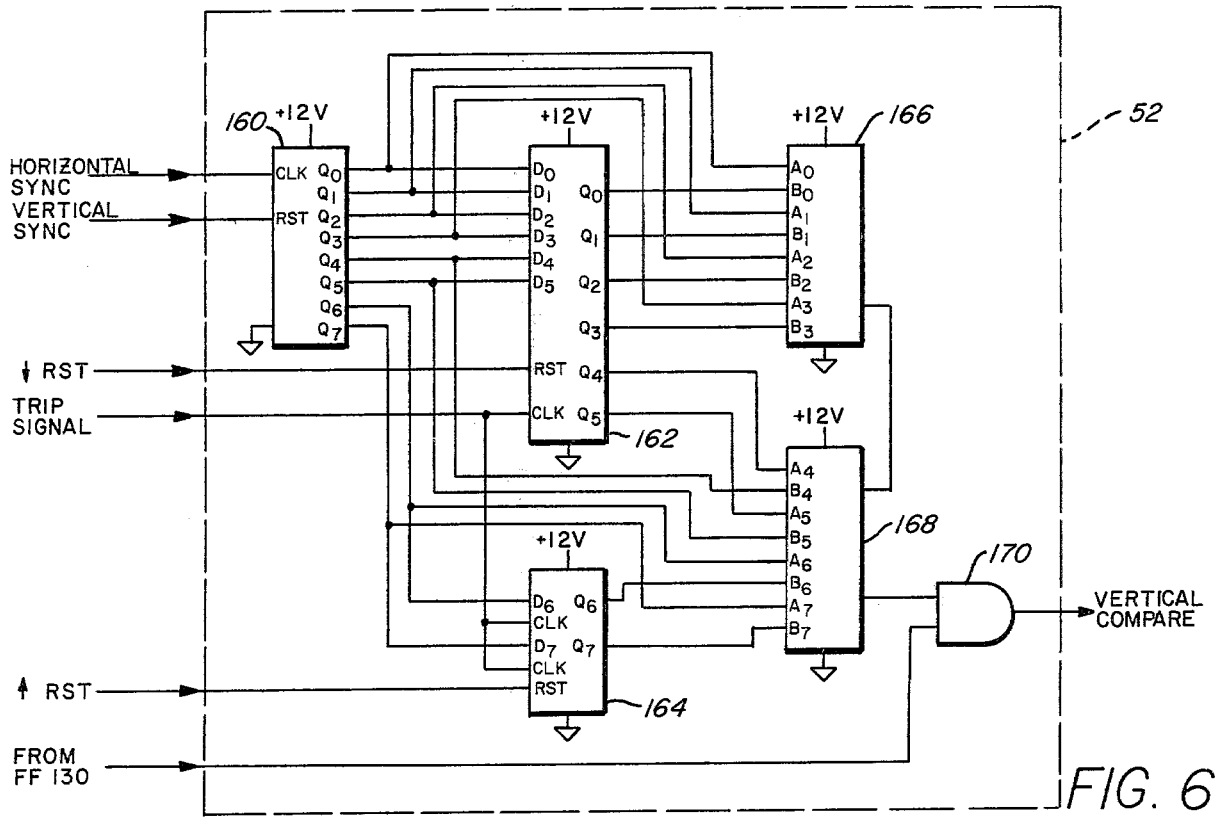
Figure 7:
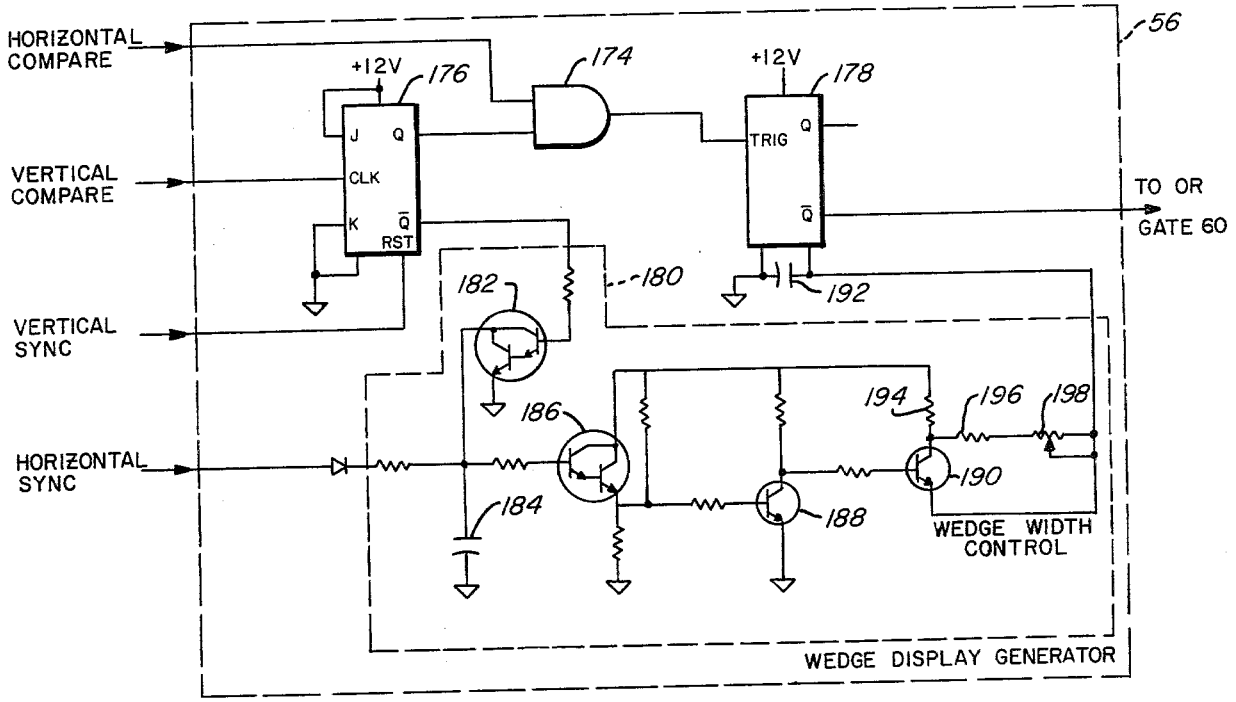
Figure 8:
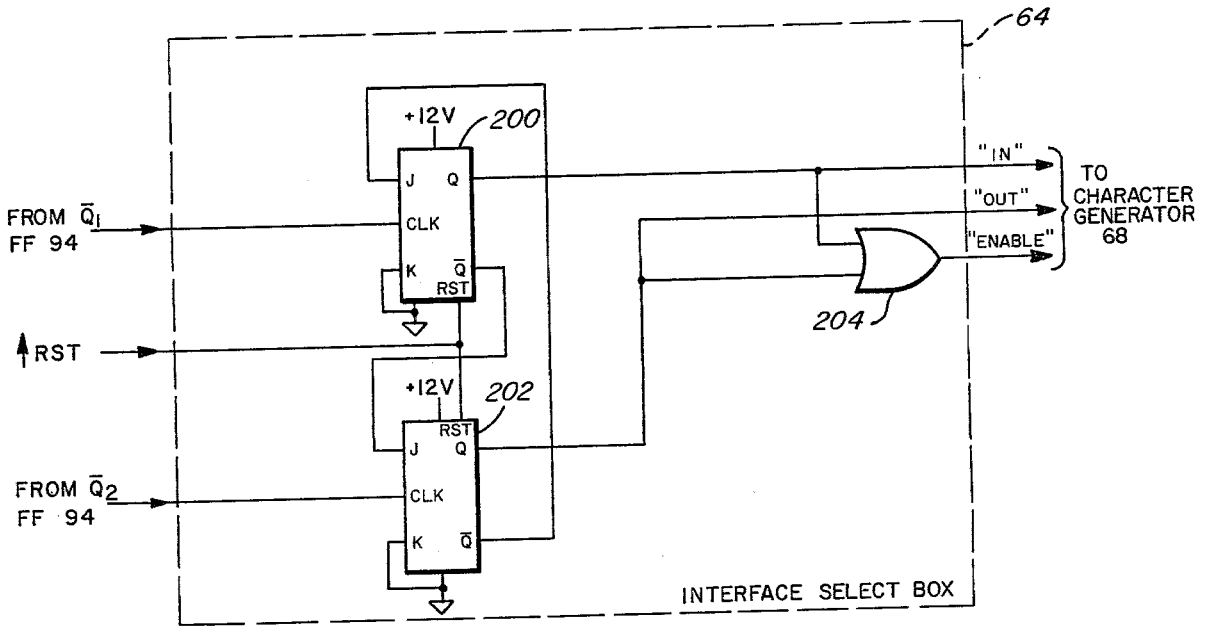

During each subsequent counting cycle, the comparator portions of the circuits 48 and 52 detect the time at which the count stored in the storage registers equals the count of the counters so that the indicator generator may again be energized. In this manner, the indicator generator 56 is energized for repeated television frames in order to repeatedly display a wedge mark W (FIG. 9) on the screen of the television monitor 14.

The interface circuit 64 provides a signal indicating the nature of the decision detected by the indicator L to a suitable indicator in the control room, alerting the operator of the television system that an event of interest has occurred, as well as indicating the nature of the decision made by the indicator L. The matrix character generator circuit 68 forms a message which is furnished to the replay recorder 10 indicating the nature of the event of interest, as detected and indicated by the interface circuit 64.

An example display (FIG. 9) sets forth a rendition of a television monitor 14 controlled by an apparatus A of the present invention. The wedge mark W displayed therein is formed in character generator 56 in the manner set forth to indicate the television picture frame during which the indicator L detected an interruption. If necessary, the recorder 10 may be switched to stop action on replay and stopped at the frame of occurrence of the interruption. In this manner, the location of the ball, otherwise indeterminate due to its speed, as indicated by a blurred image 210, with respect to the line or boundary 212 is discernible. Thus, regardless of how swiftly the ball was moving, the time of occurrence of the event as detected by indicator L is made visible on the monitor 14. Thus, both players and game officials may consult the television image should a dispute arise as to the propriety of the decision of the official.

The foregoing disclosure and description of the invention are illustrative and explanatory thereof, and various changes in the size, shape and materials, as well as in the preferred embodiment of the application may be made without departing from the spirit of the invention.

We claim:

1. An apparatus for controlling the operation of a television system, which includes a replay recorder at sports contests to monitor events of interest during the contests, comprising:

(a) means for receiving a signal indicating occurrence of an event of interest;

(b) means for forming a signal for transfer to the replay recorder indicating occurrence of the event of interest; and (c) means for generating an indicator mark for provision to the replay recorder indicating the time of occurrence of the event of interest.

2. The apparatus of claim 1, wherein said means for receiving comprises:

means for receiving a signal indicating occurrence of an event along a line or boundary during the sports contest.

3. The apparatus of claim 1, further including:

line indicator means for detecting occurrence of events along a line or boundary during the sports contest.

4. The apparatus of claim 3, wherein the line or boundary establishes whether a ball used in the sports contest lands in or out of the field of play, and wherein said line indicator means comprises:

means for detecting whether the ball lands in or out of the field of play.

5. The apparatus of claim 4, wherein said means for detecting forms a signal indicating whether the ball lands in or out, and further including:

display selector means for indicating whether the signal from said means for detecting indicates the ball lands in or out.

6. The apparatus of claim 3, wherein the sports contest is a tennis match.

7. The apparatus of claim 1, further including:

character generator means for forming messages for provision to the replay recorder to indicate the nature of the event of interest.

8. The apparatus of claim 1, wherein vertical and horizontal blanking intervals occur in the television system to synchronize operation thereof, and further including:

blanking delay means for delaying the signal indicating occurrence of the event of interest to a time outside that of the blanking intervals.

9. The apparatus of claim 1, wherein an image is formed in the television system by a series of horizontal scans occurring in a vertical sequence, and further including:

horizontal counter means for dividing the horizontal scans into a discrete number of count intervals.

10. The apparatus of claim 9, further including:

horizontal storage means responsive to said means for receiving to store an output count from said horizontal counter means on occurrence of the event of interest.

11. The apparatus of claim 10, further including:

(a) horizontal comparator means for comparing the outputs of said horizontal counter means and said horizontal storage means and indicating when the outputs are equal; and (b) pulse generator means for forming a pulse energizing said means for generating in response to the indicator from said horizontal comparator means.

12. The apparatus of claim 11, further including:

(a) vertical counter means for counting the number of horizontal scans in the vertical sequence;

(b) vertical storage means responsive to said means for receiving to store an output count from said vertical counter means on occurrence of the event of interest;

(c) vertical comparator means for comparing the outputs of said vertical counter means and said vertical storage means and indicating when the outputs are equal; and (d) said pulse generator means further comprising means for forming a pulse energizing said means for generating in response to the presence of indications from both said horizontal comparator means and said vertical comparator means.

13. A method controlling the operation of a television system, which includes a replay recorder at sports contests to monitor events of interest during the contests, comprising the steps of:

(a) receiving a signal indicating occurrence of an event of interest;

(b) forming a signal for transfer to the replay recorder indicating occurrence of the event of interest; and (c) generating an indicator mark for provision to the replay recorder indicating the time of occurrence of the event of interest.

14. The method of claim 13, wherein said step of receiving comprises:

receiving a signal indicating occurrence of an event along a line or boundary during the sports contest.

15. The method of claim 13, further including the step of:

detecting occurrence of events along a line or boundary during the sports contest.

16. The method of claim 15, wherein the line or boundary establishes whether a ball used in the sports contest lands in or out of the field of play, and wherein said step of detecting comprises:

detecting whether the ball lands in or out of the field of play.

17. The method of claim 16, wherein said step of detecting includes the step of forming a signal indicating whether the ball lands in or out, and further including the step of:

indicating whether the signal formed indicates the ball lands in or out.

18. The method of claim 15, wherein the sports contest is a tennis match.

19. The method of claim 13, further including the step of:

forming messages for provision to the replay recorder to indicate the nature of the event of interest.

20. The method of claim 13, wherein vertical and horizontal blanking intervals occur in the television system to synchronize operation thereof, and further including the step of:

delaying the signal indicating occurrence of the event of interest to a time outside that of the blanking intervals.

21. The method of claim 13, wherein an image is formed in the television system by a series of horizontal scans occurring in a vertical sequence, and further including the step of:

dividing the horizontal scans into a discrete number of count intervals.

22. The method of claim 21, further including the step of:

storing an output count of the number of count intervals on occurrence of the event of interest.

23. The method of claim 22, further including the step of:

(a) comparing the present number of count intervals and the stored output count;

(b) indicating when the compared counts are equal; and (c) forming a pulse to commence said step of generating in response to said step of indicating.

24. The method of claim 23, further including the step of:

(a) counting the number of horizontal scans in the vertical sequence;

(b) storing an output count of the number of horizontal scans on occurrence of the event of interest;

(c) comparing the present number of horizontal scans and the stored output count;

(d) indicating when the compared counts are equal; and (e) forming a pulse to commence said step of indicating.

* * * * *